US008569215B2

(12) United States Patent
Cha

(10) Patent No.: US 8,569,215 B2
(45) Date of Patent: Oct. 29, 2013

(54) TRANSMISSION OIL COMPOSITION FOR PUSH BELT CONTINUOUSLY VARIABLE TRANSMISSION

(75) Inventor: Sang Yeob Cha, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 76 days.

(21) Appl. No.: 13/299,604

(22) Filed: Nov. 18, 2011

(65) Prior Publication Data

US 2013/0065802 A1 Mar. 14, 2013

(30) Foreign Application Priority Data

Sep. 8, 2011 (KR) ..... 10-2011-0091472

(51) Int. Cl.

| | |
|---|---|
| ***C10M 169/04*** | (2006.01) |
| ***C10M 133/56*** | (2006.01) |
| ***C10M 153/00*** | (2006.01) |
| ***C10M 117/00*** | (2006.01) |

(52) U.S. Cl.
USPC ..... 508/189; 508/287; 508/291; 508/293

(58) Field of Classification Search
USPC ..... 508/189, 287, 291, 293
See application file for complete search history.

(56) References Cited

U.S. PATENT DOCUMENTS

| | | | | |
|---|---|---|---|---|
| 6,451,745 | B1 * | 9/2002 | Ward | 508/192 |
| 2010/0210490 | A1 * | 8/2010 | Vickerman et al. | 508/162 |

FOREIGN PATENT DOCUMENTS

| | | | |
|---|---|---|---|
| JP | 2001323292 | A | 11/2001 |
| JP | 2009286831 | A | 12/2009 |
| KR | 10-2005-0028808 | | 3/2005 |
| KR | 100680371 | B1 | 2/2007 |
| WO | 2009090914 | A1 | 7/2009 |

* cited by examiner

*Primary Examiner* — Cephia D Toomer
*Assistant Examiner* — Vishal Vasisth
(74) *Attorney, Agent, or Firm* — Edwards Wildman Palmer LLP; Peter F. Corless

(57) ABSTRACT

Disclosed is a transmission oil composition for use in a push belt continuously variable transmission (CVT). The push belt CVT oil composition includes a hydrogenated base oil or a synthetic base oil admixed with a viscosity control agent, a dispersing agent, a friction control agent and other additives at specific ratios and provides improved friction characteristics, durability, thermal stability, oxidation stability and transmission performance. It can be used at various temperature ranges and can provide improved transmission efficiency (fuel efficiency).

7 Claims, No Drawings

TRANSMISSION OIL COMPOSITION FOR PUSH BELT CONTINUOUSLY VARIABLE TRANSMISSION

CROSS-REFERENCE TO RELATED APPLICATIONS

This application claims priority under 35 U.S.C. §119 to Korean Patent Application No. 10-2011-0091472, filed on Sep. 8, 2011, the disclosure of which is incorporated herein by reference in its entirety.

BACKGROUND (a) Technical Field

The present invention relates to a transmission oil composition for use in a push belt continuously variable transmission (CVT). More particularly, the present invention relates to a push belt CVT oil composition including a hydrogenated base oil or synthetic base oil as well as a viscosity control agent, a dispersing agent, a friction control agent and other additives, which provides improved friction characteristics, durability, thermal stability, oxidation stability and transmission performance, can be used in various temperature ranges, and can improve transmission efficiency (fuel efficiency).

(b) Background Art

In general, a transmission is provided between a clutch and a propeller shaft or between a clutch and final reduction gears to provide speed and torque conversions of the power from an engine suitable for the driving state of an automobile to the drive wheels. It is often classified into a manual transmission and an automatic transmission. The automatic transmission refers to a transmission whereby the speed and torque of the engine are converted automatically without the need of the driver's manual clutch operation and gear shifting according to the driving condition as in the manual transmission.

In order to improve transmission efficiency, multi-step automatic transmissions have been developed such as 6-speed, 7-speed, 8-speed, etc. Recently, the continuously variable transmission (CVT) is adopted increasingly.

The push belt CVT was developed by Dr. Van Doore and is adopted in many cars. The CVT allows stepless transmission through belt-pulley variation. The variable pulley presses the belt with an adequate pressure, and the gear ratio is determined by the ratio of the pressure applied to the first pulley and the second pulley. An adequate friction needs to be maintained between the pulley and the belt to avoid slippage.

As such, since an adequate friction needs to be maintained between the pulley and the belt, it is necessary to reduce wearing by friction using gears and bearings. And, when the torque converter is combined with a planetary gear system, the friction material used for the clutch should have superior friction characteristics and there should be no shifting shock during transmission.

Accordingly, focuses are given to the improvement of friction characteristics and other physical properties for transmission oil used in the CVT.

As previously known transmission oils, Japanese Patent Application Publication No. 2009-0286831 discloses a lubricating oil composition for a metal belt-type CVT comprising a base oil as well as 0.005-0.1 wt % of a phosphorus compound and 0.01-20 wt % of an ashless dispersant, an antioxidant, an extreme pressure agent, a friction control agent, a viscosity index improver, etc. as additives. Japanese Patent Application Publication No. 2001-0323292 discloses a lubricating oil composition for a push belt-type automatic transmission comprising a lubricating base oil as well as (A) an organic acid metal salt (100-1000 ppm based on the metal content), (B) an anti-wear agent and (C) a boron-containing succinimide, wherein the metal salt of the organic acid having a long-chain hydrocarbon group is selected from salicylate, carboxylate, sulfonate, phosphonate, etc. of Ca or Mg, and further comprising 0.01-5 wt % of a friction control agent, 0.1-10 wt % of an imide-based ashless dispersant, 0.05-5 wt % of an antioxidant and 1-7 wt % of a polymethacrylate viscosity index improver as additives.

However, these transmission oil compositions have physical properties, especially friction characteristics, improper to be used as the push belt CVT oil.

In order to solve this problem, Korean Patent Application Publication No. 2005-0028808 presents a power transmitting fluid comprising a base oil as well as an additive composition comprising 0.1-10 wt % of a dispersing agent such as succinimide, 0.1-3.0 wt % of an antioxidant and 0.01-1.0 wt % of an antifoaming agent as additives and further comprising a sulfur-based extreme pressure agent, a friction control agent, a viscosity index improver, etc. The additive composition acts as a phosphorous source for providing improved wear resistance and as a friction controller for providing improved anti-vibration durability. It is described that the power transmitting fluid comprising the additive composition provides improved wear resistance and improved anti-vibration durability. Although use of the power transmitting fluid for the push belt-type transmission is presented, there remain a lot to be improved in terms of friction characteristics, thermal stability, durability, or the like.

SUMMARY

The inventors of the present invention have discovered that when various additives including a viscosity control agent, a dispersing agent and a friction control agent are added to a transmission oil with specific composition, improved friction characteristics and superior physical properties including durability can be attained.

The present invention is directed to providing a transmission oil composition capable of maintaining adequate friction between a belt and a pulley of a push belt CVT and providing lubrication to gears and bearings as well as superior physical properties including clutch friction characteristics required for an automatic transmission.

In one general aspect, the present invention provides a push belt CVT oil composition including a base oil admixed with a viscosity control agent, a dispersing agent, a friction control agent, an antioxidant and an antifoaming agent as additives.

In an exemplary embodiment, the present invention provides a push belt CVT oil composition including a base oil admixed with a viscosity control agent, a dispersing agent, a friction control agent, an antioxidant and an antifoaming agent, which includes 2-8 wt % of the viscosity control agent, 1-3 wt % of a succinimide dispersing agent and 0.5-1.5 wt % of a borated dispersing agent as the dispersing agent, and 1.5-3.0 wt % of the friction control agent.

In another exemplary embodiment, the present invention provides a push belt CVT oil composition including a base oil admixed with a viscosity control agent, a dispersing agent, a friction control agent, an antioxidant and an antifoaming agent, which includes 2-8 wt % of the viscosity control agent, 1.5-4.5 wt % of the dispersing agent and 1.0-1.5 wt % of hyperalkaline borated calcium sulfonate, 0.5-1.0 wt % of hydrocarbylamine and 0.2-0.4 wt % of hyperalkaline magnesium hydrocarbylbenzenesulfonate as the friction control agent.

As a specific example, the present invention provides a push belt CVT oil composition including 2-8 wt % of a polymethacrylate viscosity control agent, 1-3 wt % of a succinimide dispersing agent, 0.5-1.5 wt % of a borated dispersing agent, 1.0-1.5 wt % of hyperalkaline borated calcium sulfonate, 0.5-1.0 wt % of hydrocarbylamine, 0.2-0.4 wt % of hyperalkaline magnesium hydrocarbylbenzenesulfonate, 0.3-0.5 wt % of calcium salicylate, 0.2-0.4 wt % of alkyl phosphate phosphoric acid, 1.0-1.4 wt % of an antioxidant, 1.0-1.5 wt % of a diluent and 0.1-0.3 wt % of borated epoxide.

The above and other aspects and features of the present invention will be described infra.

DETAILED DESCRIPTION

Hereinafter, reference will now be made in detail to various embodiments of the present invention, examples of which are described below. While the invention will be described in conjunction with exemplary embodiments, it will be understood that the present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The present invention provides a push belt CVT oil composition comprising a base oil admixed with a viscosity control agent, a dispersing agent, a friction control agent, an antioxidant and an antifoaming agent.

In an exemplary embodiment, the present invention provides a push belt CVT oil composition comprising 2-8 wt % of the viscosity control agent, 1-3 wt % of a succinimide dispersing agent and 0.5-1.5 wt % of a borated dispersing agent as the dispersing agent, 1.5-3.0 wt % of the friction control agent, and 1.0-1.4 wt % of the antioxidant.

In another exemplary embodiment, the present invention provides a push belt CVT oil composition comprising 2-8 wt % of the viscosity control agent, 1.5-4.5 wt % of the dispersing agent and 1.0-1.5 wt % of hyperalkaline borated calcium sulfonate, 0.5-1.0 wt % of hydrocarbylamine and 0.2-0.4 wt % of hyperalkaline magnesium hydrocarbylbenzenesulfonate as the friction control agent, and 1.0-1.4 wt % of the antioxidant.

The base oil may be mineral oil, highly refined mineral oil, or synthetic oil. In particular, highly refined mineral oil or synthetic oil having a kinematic viscosity of 3-10 cSt at 100° C. and a viscosity index of at least 120 may be used.

The viscosity control agent may be specifically a polymethacrylate (PMA)-based viscosity control agent. More specifically, it may be Asteric PMA having a star architecture. The viscosity control agent may be used in an amount of 2-8 wt % based on the entire composition. When the content is too low, durability may be unsatisfactory. And, when the content is too high, other properties may be unsatisfactory.

Although fuel efficiency can be improved when the viscosity of the transmission oil is low because of decreased pumping loss, the low viscosity may cause severe durability problem due to decreased oil film thickness. When highly refined base oil and Asteric PMA are used, fatigue durability (FZG.ASTM D5182) may be improved even when the viscosity is decreased to 5.4 cSt.

The dispersing agent may be used in an amount of 1.5-4.5 wt %. Specifically, the succinimide dispersing agent and the borated dispersing agent may be used together. The succinimide dispersing agent may be, for example, polyisobutenyl succinic anhydride, and the borated dispersing agent may be, for example, a reaction product of polyisobutylene succinic anhydride and boric acid. The succinimide dispersing agent may be used in an amount of 1-3 wt %, and the borated dispersing agent may be used in an amount of 0.5-1.5 wt %, based on the entire composition. When the succinimide dispersing agent is used in an amount less than 1 wt % and the borated dispersing agent is used in an amount less than 0.5 wt %, clutch friction characteristics may be unsatisfactory. In particular, the $\mu_d/\mu_0$ value in the SAE NO2 friction test, which should be maintained below 1.1, may exceed the value. The decreased clutch friction characteristics may result in clutch shock. Also, when the dispersing agent is used in excessive amount, the clutch shock may occur due to the increase of the coefficient of static friction $\mu_0$.

The friction control agent may be used in an amount of 1.5-3.0 wt % based on the entire composition. Specifically, when hyperalkaline borated calcium sulfonate, hydrocarbylamine and hyperalkaline magnesium hydrocarbylbenzenesulfonate are used as the friction control agent, the friction between the metal belt and the pulley of the push belt CVT may be increased due to the increase of the metal-metal coefficient of friction is increased and thus slippage can be prevented effectively.

For the hyperalkaline borated calcium sulfonate, one having a total base number (TBN) of 295 mg KOH/mg may be used. Specifically, the friction control agent may comprise 1.0-1.5 wt % of the hyperalkaline borated calcium sulfonate, 0.5-1.0 wt % of the hydrocarbylamine and 0.2-0.4 wt % of the hyperalkaline magnesium hydrocarbylbenzenesulfonate, based on the entire composition. In this case, transit torque can be increased up to 80 Nm while achieving good durability. In general, the higher the transit torque, the larger is the allowed torque of the push belt CVT and the lower can the pulley pressure, i.e. the clamping force, decreased. As a result, the CVT efficiency can be enhanced. However, if the transit torque is too high, durability may be unsatisfactory because of severe friction between the belt and the pulley.

In addition, other additives may also be added. For example, 0.3-0.5 wt % of calcium salicylate and 0.2-0.4 wt % of alkyl phosphate phosphoric acid as a friction control agent, 1.0-1.4 wt % of an antioxidant, 1.0-1.5 wt % of a diluent, 0.1-0.3 wt % borated epoxide as an anti-wear agent, or the like may be added.

Specifically, the resulting composition according to the present invention may have a kinematic viscosity of 5.4 cSt or lower at 100° C. and a fatigue durability (FZG.ASTM D5182) of 350 hours or longer.

A push belt CVT oil composition obtained by combining the afore-described components within the described range, adding other additives or omitting some components may be included within the scope of the present invention as long as the purpose of the present invention is attained.

The CVT oil composition of the present invention has properties very suitable to be used for the push belt CVT. Especially, with superior friction characteristics, durability, thermal stability, oxidation stability, transmission performance, etc., it can be used at various temperature ranges and can contribute to the improvement of fuel efficiency.

EXAMPLES

The examples and experiments will now be described. The following examples and experiments are for illustrative purposes only and not intended to limit the scope of this invention.

Examples 1-2 and Comparative Examples 1-6

The components described in Table 1 were mixed at the describe ratios to prepare push belt CVT oil compositions were. The unit of the contents is wt %.

TABLE 1

| | Comp. Ex. 1 | Comp. Ex. 2 | Comp. Ex. 3 | Comp. Ex. 4 | Comp. Ex. 5 | Comp. Ex. 6 | Ex. 1 | Ex. 2 |
|---|---|---|---|---|---|---|---|---|
| Base oil | | | | | | | | |
| 100N oil | 84.3 | 84.3 | 83.5 | 84.5 | 84.8 | 84.9 | 85.3 | |
| Group-3 Yubase 3 | | | | | | | | 50.75 |
| Group-3 Yubase 6 | | | | | | | | 37.85 |
| Viscosity control agent | | | | | | | | |
| PMA | 6.8 | 6.8 | 6.8 | 6.8 | 6.8 | 6.8 | 6.8 | |
| Asteric PMA | | | | | | | | 3.5 |
| Dispersing agent | | | | | | | | |
| Succinimide dispersing agent (43% diluent oil) | 3.5 | | 2 | 2 | 2 | 2 | 2 | 2 |
| Borated dispersing agent (reaction product of polyisobutylene succinic anhydride and polyethylene amine with boric acid; boron content = 1.9%; 33% diluent oil) | | 3.5 | 1.5 | 1.5 | 1.5 | 1.5 | 1 | 1 |
| Hyperalkaline calcium sulfonate | | | | | | | | |
| Hyperalkaline calcium silicate (40% diluent oil; TBN = 165) | 0.4 | 0.4 | | | | | | |
| Hyperalkaline calcium sulfonate (50% diluent oil; TBN = 10) | 2.3 | 2.3 | | | | | | |
| Borated hyperalkaline calcium sulfonate (boron content = 1.83%; 50% diluent oil; TBN = 295) | | | 3.5 | 2.5 | 1.5 | 1.8 | 1.2 | 1.2 |
| Friction control agent | | | | | | | | |
| Hydrocarbylamine (US20100210490) | | | | | 0.7 | | 0.7 | 0.7 |
| Hyperalkaline magnesium hydrocarbylbenzene-sulfonate | | | | | | 0.3 | 0.3 | 0.3 |
| Calcium salicylate | 0.4 | 0.4 | 0.4 | 0.4 | 0.4 | 0.4 | 0.4 | 0.4 |
| Alkyl phosphate phosphoric acid | 0.3 | 0.3 | 0.3 | 0.3 | 0.3 | 0.3 | 0.3 | 0.3 |
| Antioxidant | 0.6 | 0.6 | 0.6 | 0.6 | 0.6 | 0.6 | 0.6 | 0.6 |
| Diluent | 1.2 | 1.2 | 1.2 | 1.2 | 1.2 | 1.2 | 1.2 | 1.2 |
| Borated epoxide | 0.2 | 0.2 | 0.2 | 0.2 | 0.2 | 0.2 | 0.2 | 0.2 |
| Total | 100 | 100 | 100 | 100 | 100 | 100 | 100 | 100 |

(Note)

In Table 1, the base oils Group-3 Yubase 3 and Group-3 Yubase 6 are products of SK Lubricant.

Test Example

Various physical properties were tested for Examples and Comparative Examples. Test methods are described below and the result is shown in Table 4.

(1) SAE NO2 Friction Test

SAE NO2 friction test was carried out under the condition described in Table 2. The endpoint dynamic friction coefficient ($\mu_0$) was measured at end of the dynamic cycle, the coefficient of dynamic friction ($\mu_d$) was measured when the friction plate was rotating at 1,800 rpm, and the coefficient of static friction ($\mu_s$) was measured during the static cycle. The result is shown in Table 4.

TABLE 2

| | | Dynamic | Static |
|---|---|---|---|
| Revolution | rpm | 5,000 | — |
| Rotating time | s/cycle | 30 | — |
| Energy absorption | J (kg · m) | 1,063 (1,085) | — |
| Inertia | kg · m$^2$ | 0.214 | — |
| Revolution | rpm | 3,000 | 0.72- |
| Load | kN (kgf) | 4.854 (495.3) | 5.88 (600) |
| Surface pressure | MPa (kgf/cm$^2$) | 1.04 (10.6) | 1.26 (12.9) |
| Oil volume | L | 0.7 | 0.7 |
| Oil temperature | ° C. | 100 | 100 |

(2) KRL Shear Stability Test

KRL shear stability test was performed according to CEC L45-T (KRL Shear Stability Test).

(3) LFW-1 Friction Test

LFW-1 friction test was performed according to ASTM D2714 (Standard Test Method for Calibration and Operation of the Falex Block-on-Ring Friction and Wear Testing Machine).

(4) Belt-Pulley Friction and Durability Test

Belt-pulley friction and durability test was performed according to SAE 2003-01-3253 Van Doorne CVT Fluid Test (A Test Method on Belt-pulley Level to Select Fluids for Push Belt CVT Applications).

(5) Low-Temperature Fluidity Test

Low-temperature fluidity test was performed according to ASTM D2983 (Test Method for Low-Temperature Viscosity of Automotive Fluid Lubricants Measured by Brookfield Viscometer).

(6) Kinematic Viscosity Measurement

Kinematic viscosity was measured according to ASTM D 445 (Test Method for Kinematic Viscosity of Transparent and Opaque Liquids).

(7) Fatigue Durability Test

Fatigue durability of gears was evaluated according to ASTM D5182 (Standard Test Method for Evaluating the Scuffing Load Capacity of Oils; FZG Visual Method). The test condition is shown in Table 3 and the test result is shown in Table 4.

TABLE 3

| | Break in | Endurance |
|---|---|---|
| RPM | 1440 rpm | 1440 rpm |
| Load | 6 stage | 9 stage |
| Duration | 2 hours | Every 12 hours |
| Gear type | C type | |
| Temperature | 90° C. | |

Also, it was confirmed that a better result was obtained when the succinimide dispersing agent and the borated dispersing agent were used together as the dispersing agent, specifically when 1-3% of the succinimide dispersing agent and 0.5-1.5% of the borated dispersing agent were used. When the succinimide dispersing agent was used in an amount less than 1% or when the borated dispersing agent was used in an amount less than 0.5%, satisfactory clutch friction characteristics were not achieved. That is to say, in Comparative Examples 1-2, the $\mu_d/\mu_0$ value exceeded 1.1. In this case, clutch shock may occur during operation of the clutch.

Also, it was confirmed that satisfactory durability and transit torque (up to 80 Nm) could be obtained in the belt-pulley test when the hyperalkaline borated calcium sulfonate had a total base number (TBN) of 295 mg KOH/mg and 1.0-1.5% of the hyperalkaline borated calcium sulfonate, 0.5-1.0% of the hydrocarbylamine and 0.2-0.4% of the hyperalkaline magnesium hydrocarbylbenzenesulfonate were used. The higher the transit torque, the larger is the allowed torque of the push belt CVT and the lower can the pulley pressure. As a result, the CVT efficiency can be enhanced. When the amount of the friction control agent was outside the range of the present invention as in Comparative Examples 1-2, the transit torque was too high and thus the durability was unsatisfactory because of severe friction between the belt and the pulley.

To conclude, it was confirmed that superior friction characteristics and various physical properties including durability are attained when the requirements of the present invention are satisfied The push belt CVT oil composition of the present invention, which comprises a base oil admixed with a viscosity control agent, a dispersing agent, a friction control agent, an antioxidant and an antifoaming agent, especially with the dispersing agent and the friction control agent comprising specific components of specific composition, has adequate viscosity and improved coefficient of friction. Thus, it can reduce pumping loss and improve durability as well as clutch friction characteristics, durability, thermal stability, oxidation stability, transmission performance, or the like. Accordingly, it can be used at various temperature ranges and can provide improved transmission efficiency (fuel efficiency).

TABLE 4

| | Comp. Ex. 1 | Comp. Ex. 2 | Comp. Ex. 3 | Comp. Ex. 4 | Comp. Ex. 5 | Comp. Ex. 6 | Ex. 1 | Ex. 2 |
|---|---|---|---|---|---|---|---|---|
| SAE NO2 | | | | | | | | |
| $\mu_d$ | 0.12 | 0.12 | 0.11 | 0.11 | 0.11 | 0.11 | 0.11 | 0.11 |
| $\mu_s$ | 0.1 | 0.1 | 0.1 | 0.95 | 0.1 | 0.1 | 0.1 | 0.1 |
| $\mu_0/\mu_d$ | 1.15 | 1.15 | 1.05 | 1.05 | 1.05 | 1.05 | 1.05 | 1.05 |
| KRL (40 h, %) | | | | | | | 25.7 | 5 |
| LFW-1 | 0.11 | 0.1 | 0.135 | 0.135 | 0.135 | 0.135 | 0.137 | 0.137 |
| Belt-pulley test | | | | | | | | |
| Durability | fail | fail | fail | pass | pass | pass | pass | pass |
| Transit torque (Nm) | 70 | 55 | 75 | 60 | 60 | 60 | 80 | 80 |
| BF (−40° C., cP) | 18500 | 19000 | 18500 | 18000 | 18000 | 18500 | 8200 | 8000 |
| KV (100° C., cSt) | 7 | 7 | 7 | 7 | 7 | 7 | 7 | 5.4 |
| FZG (hr) | 200 | 350 | 200 | 200 | 250 | 250 | 310 | 350 |

As seen from the test result, although fuel efficiency can be improved when the viscosity of the transmission oil is low because of decreased pumping loss, the low viscosity causes severe durability problem due to decreased oil film thickness. It was confirmed that, when highly refined base oil and Asteric PMA were used as in Examples 1-2, FZG durability could be improved even when the viscosity was decreased to 5.4 cSt.

The present invention has been described in detail with reference to specific embodiments thereof. However, it will be appreciated by those skilled in the art that various changes and modifications may be made in these embodiments without departing from the principles and spirit of the invention, the scope of which is defined in the appended claims and their equivalents.

What is claimed is:

1. A push belt continuously variable transmission (CVT) oil composition comprising a base oil admixed with 2-8 wt % of a polymethacrylate viscosity control agent, 1-3 wt % of a succinimide dispersing agent, 0.5-1.5 wt % of a borated dispersing agent, 1.0-1.5 wt % of hyperalkaline borated calcium sulfonate, 0.5-1.0 wt % of hydrocarbylamine, 0.2-0.4 wt % of hyperalkaline magnesium hydrocarbylbenzenesulfonate, 0.3-0.5 wt % of calcium salicylate, and 0.2-0.4 wt % of alkyl phosphate phosphoric acid as friction control agent, 1.0-1.4 wt % of an antioxidant, 1.0-1.5 wt % of a diluent and 0.1-0.3 wt % of borated epoxide as an anti-wear agent, wherein the base oil is highly refined mineral oil or synthetic oil having a kinematic viscosity of 3-10 cSt at 100° C. and a viscosity index of at least 120.

2. The push belt CVT oil composition according to claim 1, wherein the hyperalkaline borated calcium sulfonate has a total base number (TBN) of 295 mgKOH/mg.

3. The push belt CVT oil composition according to claim 1, which has a kinematic viscosity of 5.4 cSt or lower at 100° C. and a fatigue durability (FZG.ASTM D5182) of 350 hours or longer.

4. A push belt continuously variable transmission (CVT) oil composition comprising a base oil admixed with a viscosity control agent, a dispersing agent, a friction control agent, and an antioxidant, which comprises 2-8 wt % of the viscosity control agent, 1.5-4.5 wt % of the dispersing agent, 1.0-1.5 wt % of hyperalkaline borated calcium sulfonate, 0.5-1.0 wt % of hydrocarbylamine, 0.2-0.4 wt % of hyperalkaline magnesium hydrocarbylbenzenesulfonate as the friction control agent, and 1.0-1.4 wt % of an antioxidant, wherein the viscosity control agent is a polymethacrylate (PMA) having a start architecture, wherein the base oil is highly refined mineral oil or synthetic oil having a kinematic viscosity of 3-10 cSt at 100° C. and a viscosity index of at least 120.

5. The push belt CVT oil composition according to claim 4, which comprises 2-8 wt % of a polymethacrylate viscosity control agent, 1-3 wt % of a succinimide dispersing agent, 0.5-1.5 wt % of a borated dispersing agent, 1.0-1.5 wt % of hyperalkaline borated calcium sulfonate, 0.5-1.0 wt % of hydrocarbylamine, 0.2-0.4 wt % of hyperalkaline magnesium hydrocarbylbenzenesulfonate, 0.3-0.5 wt % of calcium salicylate, 0.2-0.4 wt % of alkyl phosphate phosphoric acid, 1.0-1.4 wt % of an antioxidant, 1.0-1.5 wt % of a diluent and 0.1-0.3 wt % of borated epoxide.

6. The push belt CVT oil composition according to claim 4, wherein the hyperalkaline borated calcium sulfonate has a total base number (TBN) of 295 mgKOH/mg.

7. The push belt CVT oil composition according to claim 4, which has a kinematic viscosity of 5.4 cSt or lower at 100° C. and a fatigue durability (FZG.ASTM D5182) of 350 hours or longer.

* * * * *